US007469052B2

(12) United States Patent
Peavey

(10) Patent No.: US 7,469,052 B2
(45) Date of Patent: Dec. 23, 2008

(54) PORTABLE SOUND SYSTEM, APPARATUS, AND METHOD

(75) Inventor: Hartley D. Peavey, Meridian, MS (US)

(73) Assignee: Peavey Electronics Corporation, Meridian, MI (US)

( * ) Notice: Subject to any disclaimer, the term of this patent is extended or adjusted under 35 U.S.C. 154(b) by 998 days.

(21) Appl. No.: 10/872,260

(22) Filed: Jun. 18, 2004

(65) Prior Publication Data

US 2005/0281426 A1 Dec. 22, 2005

(51) Int. Cl.

| | |
|---|---|
| ***H04R 9/06*** | (2006.01) |
| ***H04R 1/02*** | (2006.01) |
| ***H04R 27/00*** | (2006.01) |
| ***A45C 13/00*** | (2006.01) |

(52) U.S. Cl. ..... 381/334; 381/87; 381/386; 381/82; 190/102

(58) Field of Classification Search ..... 381/334, 381/87, 332, 333, 61, 119, 82, 118, 120, 381/300, 305, 306, 386, 387, 388, 395; 248/220.21, 248/223.41, 224.51, 224.61; 700/94; 369/4; 190/102, 103, 105, 109, 110

See application file for complete search history.

(56) References Cited

U.S. PATENT DOCUMENTS

| | | | | |
|---|---|---|---|---|
| 3,038,964 | A | 6/1962 | Bose | 179/1 |
| 3,370,125 | A * | 2/1968 | Shaw et al. | 381/120 |
| 3,848,944 | A * | 11/1974 | Gilmer, Jr. | 312/314 |
| 4,061,890 | A | 12/1977 | Froeschle | 179/115.5 |
| 4,146,745 | A | 3/1979 | Froeschle et al. | 179/1 |
| 4,158,756 | A | 6/1979 | Keezer | 179/115.5 |
| 4,450,495 | A * | 5/1984 | Naruki | 360/137 |
| 4,896,360 | A * | 1/1990 | Knight | 381/82 |
| 5,903,657 | A * | 5/1999 | Chuo | 381/388 |
| 5,933,507 | A * | 8/1999 | Woolley et al. | 381/300 |
| 7,043,044 | B2 * | 5/2006 | Amid-Hozour | 381/388 |
| 7,242,785 | B2 * | 7/2007 | McNary | 381/182 |
| 2002/0176593 | A1 * | 11/2002 | Magnusson et al. | 381/301 |
| 2003/0076971 | A1 * | 4/2003 | Sperle et al. | 381/306 |
| 2003/0095671 | A1 * | 5/2003 | Long | 381/87 |

FOREIGN PATENT DOCUMENTS

EP 15590 A1 * 9/1980

* cited by examiner

*Primary Examiner*—Vivian Chin
*Assistant Examiner*—Kile Blair
(74) *Attorney, Agent, or Firm*—Thomas, Kayden, Horstemeyer & Risley, LLP

(57) ABSTRACT

A portable sound unit is shown having a central case and one or more speakers. Each speaker has tongue rails around a portion of its circumference. The central case includes an openable lid permitting access to sound equipment contained within the central case. The central case has openings at either end when the lid is closed and grooves inside a portion of the central case near each opening. The grooves receive the tongue rails on the speaker when the lid is open. Upon positioning a speaker in the grooves in the central body, the lid may be closed, thereby securing the speakers to the central case. When the speakers are separated from the central case and electronically coupled to the sound equipment, the opened lid may serve as a lectern.

15 Claims, 9 Drawing Sheets

14

PORTABLE SOUND SYSTEM, APPARATUS, AND METHOD

FIELD OF THE INVENTION

The present invention relates to audio systems, more specifically to a system and method for configuring a portable sound system.

BACKGROUND OF THE INVENTION

Before the advent of electronic sound amplification, public speaking and performing was typically accomplished by vocal projection in an effort to communicate to, by today's standards, small crowds and audiences. In rural areas, speakers have historically been, and to some extent still are, limited in clearly communicating their messages to large numbers of people at one time. Indeed, politicians have been known to stand on tree stumps and plead for constituent's votes. However, "stumping," as it is called, has always limited the communicator to reaching just the people within the sound of the communicator's unamplified voice.

Yet, with the invention of sound amplification devices, speakers at churches, civic organizations and even outdoor arenas are able to communicate their message to a greater number of people through electronic microphones, amplifiers and speakers placed within the facility or arena. Indeed, many such facilities are electronically prewired with sound amplification equipment so that speakers and other performing artists can speak to or perform before a greater number of people.

However, a problem exists where people attempt to communicate to groups, crowds, etc. at facilities that are not necessarily prewired for sound amplification. Even today, many speakers and other performing artists are limited by either the number of people who can hear their unamplified voice or by venues having sound systems, as many venues are not electronically wired for sound amplification.

Speakers, such as preachers and politicians, and other performing artists commonly travel to areas that are not equipped with sound amplification equipment. As a result, the message or performed art cannot generally be viewed or heard by a large number of people. For that reason, speakers and other performing artists sometimes bring their own sound amplification equipment in an attempt to communicate with larger audiences. Because of the size of such equipment and the number of requisite components, this oftentimes results in the speaker or other performing artist having to arrange for special transportation (i.e., a separate truck or trailer) for the sound amplification equipment. Indeed, in this instance, assistance in unloading and assembling the equipment prior to the event is common due to the size and number of components. Likewise, disassembly of the equipment and reloading of the truck or trailer after the event typically involves assistance. Plus, in each case, planning and supervision are typically required.

In many instances, this is impractical for individuals who merely desire to deliver a speech to a school, a church, a civic organization, or to some other small venue where it is impractical to also bring a large amount of sound amplification equipment. For example, many politicians attempt to get their message out to as many people as possible in as short a period of time as possible; therefore, continually erecting and taking down sound amplification equipment is not practical for a politician who may have a number of speaking engagements in one day. Thus, in this nonlimiting example, the politician typically either utilizes venues previously equipped with appropriate sound amplification equipment, which may be too expensive to obtain or otherwise be unavailable, or they use their unamplified voice and hope to reach as many people as possible.

At least one attempt to solve these problems is found in devices where an amplifier mixer, speakers, and microphones are prepackaged together as a single unit. In such devices, the speakers are latched to the amplifier so that the unit is relatively small and capable of being transported by one or a small number of people. Upon arrival at the desired location, which may not have adequate sound amplification equipment, the speakers can be unlatched and electrically connected to the amplifier mixer, which itself may be connected to, for example, a microphone.

However, the problem with these types of units is that, because the speakers are commonly one of the larger components of the unit, insuring secure transport of the device is difficult. Securing the speakers to these types of units for transport in a way that allows safe handling of the unit and protection of the equipment must be considered. For if the speakers become unattached from the unit during transport, damage to the equipment and/or injury to the handler could result.

Consequently, some such systems include latches or other coupling components to secure the speakers to the unit during non-use and/or transportation between events. When the components are unpacked and prepared for use, the latches or other metal coupling components on the speakers vibrate during performances, thereby introducing undesirable sound effects into the speech or other performed art.

For these reasons then, a heretofore unaddressed need exists in the industry to address the aforementioned deficiencies.

DESCRIPTION OF THE DRAWINGS

Many aspects of the invention can be better understood with reference to the following drawings. The components in the drawings are not necessarily to scale, emphasis instead being placed upon clearly illustrating the principles of the present invention. In fact, no particular emphasis is placed on any ornamental aspect shown in the drawings. Indeed, one or ordinary skill in the art would know that other ornamentally different embodiments may be configured that still illustrate the principles of the invention described herein. Moreover, in the drawings, like reference numerals designate corresponding parts throughout the several views.

DETAILED DESCRIPTION OF THE PREFERRED EMBODIMENT

A portable sound unit with a central case and one or more speakers is described and shown herein. In one nonlimiting example, each speaker has "tongue" rails around all of, or a portion of, its circumference. The central case includes an openable lid permitting access to sound equipment contained within the central case. The central case has openings at either end when the lid is closed and grooves inside a portion of the central case near each opening. The grooves receive the "tongue" rails on the speaker when the lid is open. Upon positioning a speaker in the grooves of the central body, the lid containing grooves similar to the central case may be closed, thereby securing the speakers around the entire periphery of the speaker to the central case. When the speakers are separated from the central case and electronically coupled to the sound equipment, the opened lid may serve as a lectern.

The drawings referenced herein are showings for the purposes of illustrating embodiments of the invention and not for purposes of limiting same. In fact, this description of each preferred and alternative embodiment comprises but select embodiments among others, which one of ordinary skill in the art would know upon review of this disclosure.

Figure 1:
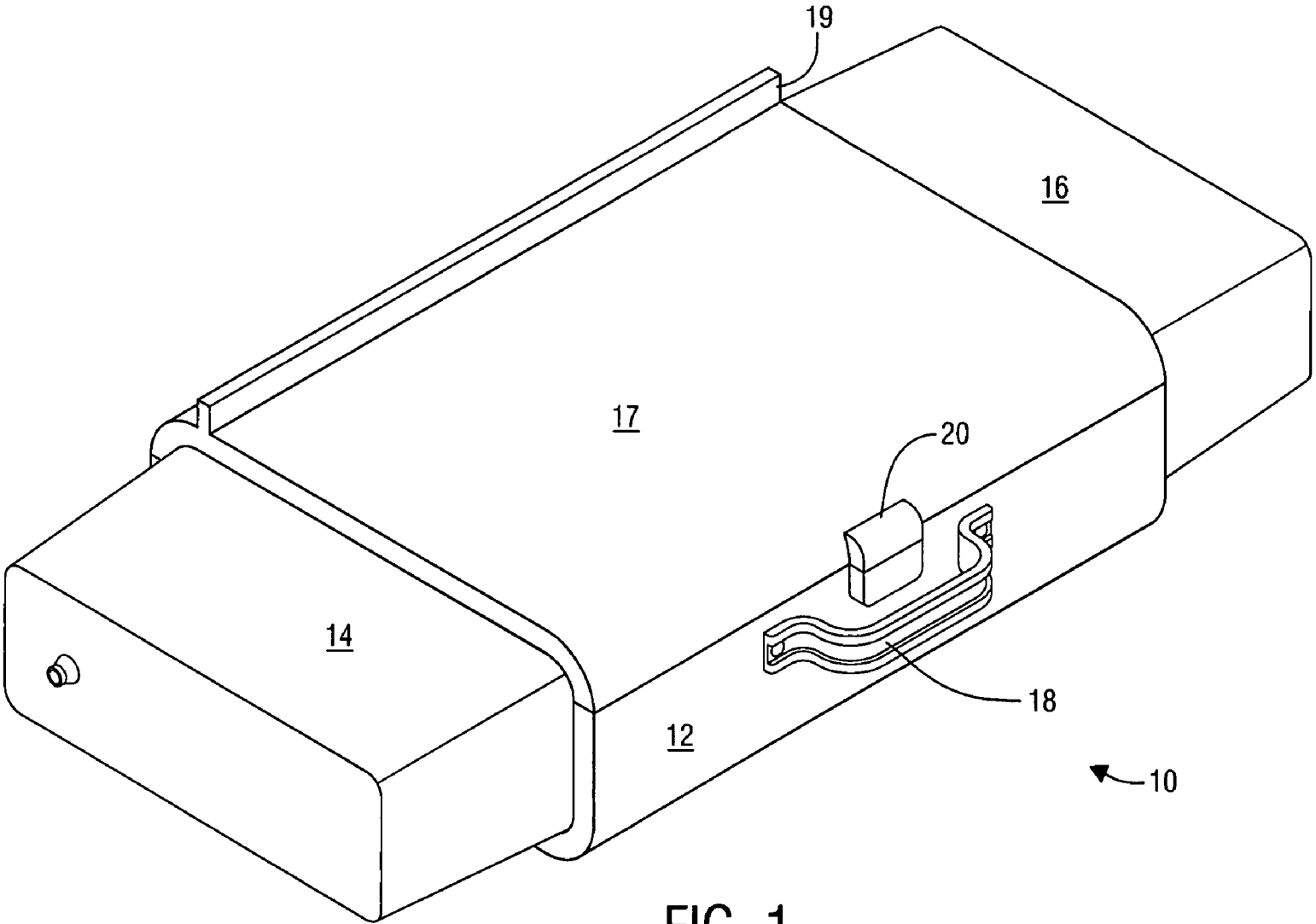
FIG. 1 is a perspective view diagram of the portable sound unit of the present invention, as shown in a closed position with two speakers attached.

FIG. 1 is a diagram of the portable sound unit 10. In this embodiment, the portable sound unit 10 includes central body 12 and speakers 14, 16. Central body 12 is shown herein with lid 17 in a closed position. Attached on either side of the central body 12 are speakers 14 and 16, which are shown as being captured by the central body 12 and the lid 17.

Figure 4:
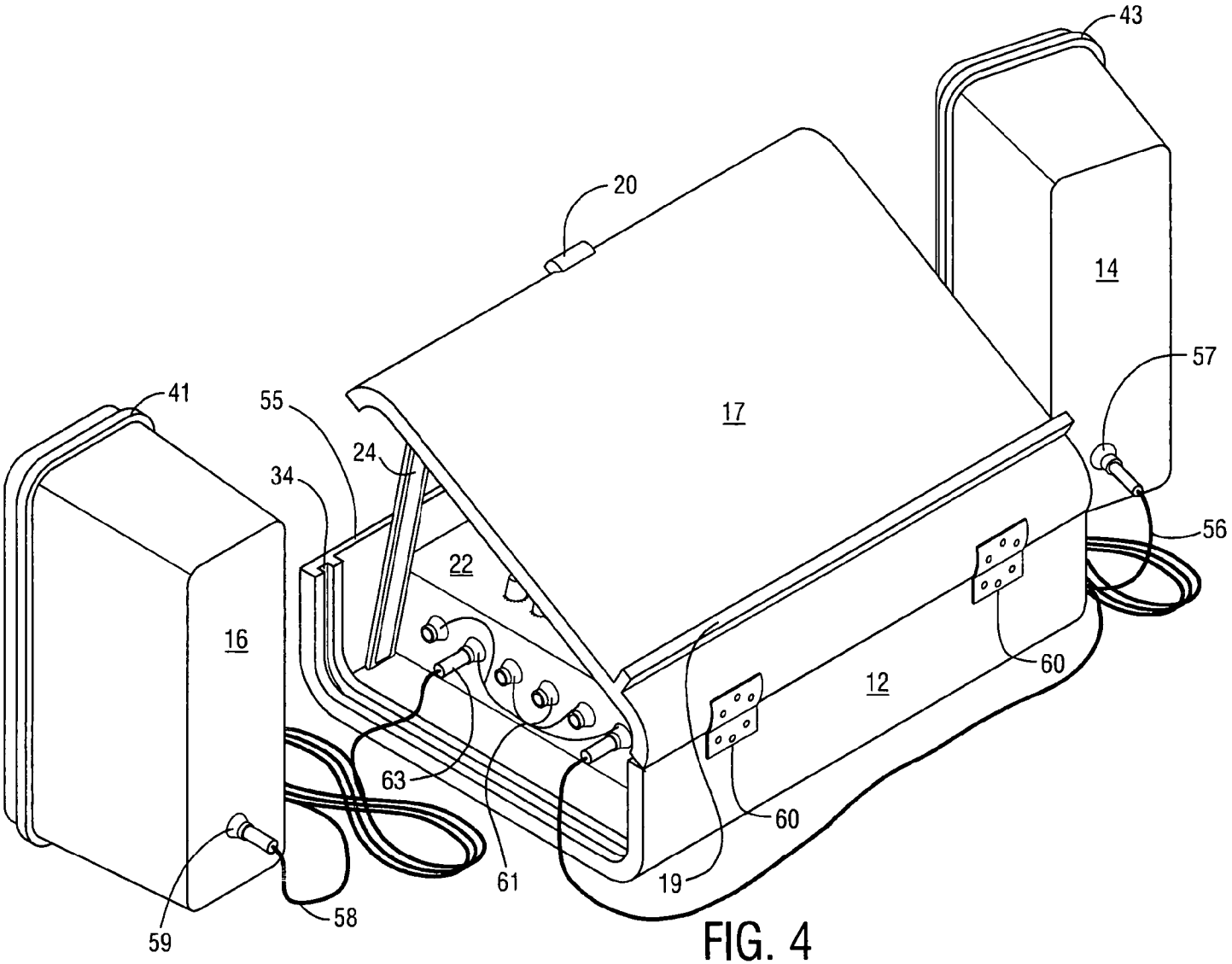
FIG. 4 is a rear perspective view of the portable sound unit of FIG. 1 with the speakers unattached and electronically coupled to the mixer of FIG. 2 and also with the lid in an open position.

As discussed in more detail below, lid 17 of central body 12 may be removable by several methods, as one skilled in the art would know. As nonlimiting examples, hinges, clips, latches, etc. may be used to secure lid 17 to central body 12. In this nonlimiting example, lid 17 is securable to central body 12 by latch 20 and hinges 60 (FIG. 4).

Attached to lid 17 is edge 19, which as described in more detail below, enables lid 17 to operate as a lectern for holding papers and other items in place when lid 17 is held in an open position by a support bar 24 or some other auto-open method. One of ordinary skill in the art should know that edge 19 may be configured in different arrangements in addition to as shown herein. For example, edge 19 may indeed be molded into the lid 17 so as to not extend beyond the surface plane of lid 17. Stated another way, the surface of lid 17 may actually indent into the lid 17 so as to create edge 19 for holding papers or other items in place on lid 17.

Also shown in FIG. 1 is handle 18 attached to central body 12. One of ordinary skill in the art would know that any type of handle or handling mechanism could be implementing in addition to handle 18, which is merely a nonlimiting example.

As portable sound unit 10 is shown in a closed position, speakers 14 and 16 are held in place by the closing of the grooved lid 17 such that a portion of speakers 14 and 16, as more thoroughly described below, is trapped or captured within the interior of central body 12 and the lid 17. Thus, when speakers 14 and 16 are attached to central body 12, the portable sound unit 10 may be transported by an individual by being carried by handle 18. As an additional nonlimiting example, portable sound unit 10 may be rolled by wheels attached to the underside of central body 12 (not shown) in similar fashion to rollable luggable. In this nonlimiting example, handle 18 may be configured such that it telescopes to an extended position to enable a user to roll the portable sound unit 10 to its desired location.

Figure 2:
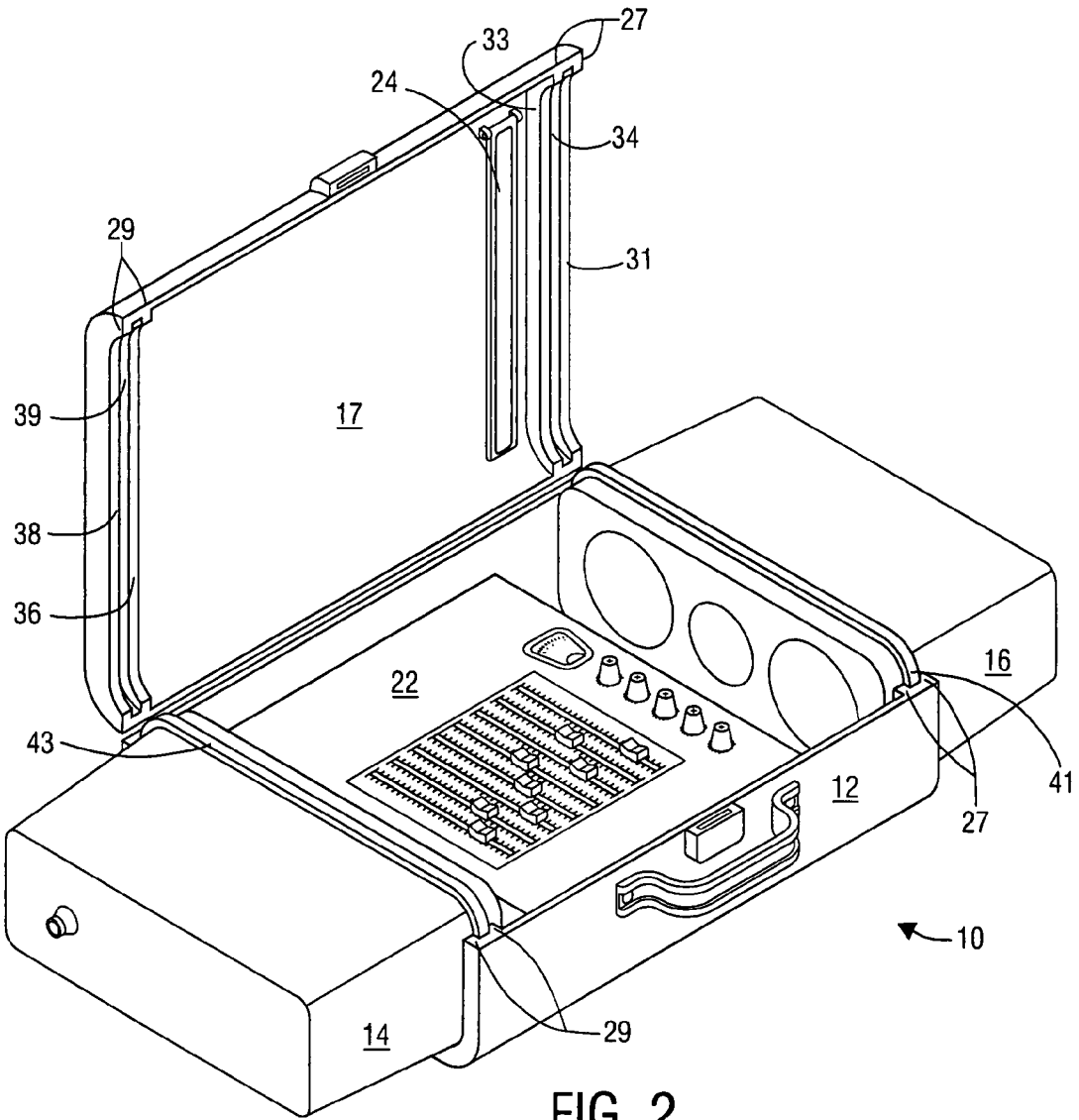
FIG. 2 is a perspective view diagram of the portable sound unit of FIG. 1 with the lid shown in an open position exposing the speakers and mixer panel.

FIG. 2 is a diagram of portable sound unit 10 shown with lid 17 in an open position. Shown attached to the inside surface of lid 17 is support 24. In this nonlimiting example, support 24 hinges from the inside surface of lid 17 for supporting lid 17 in an angled position relative to the plane of central body 12. In this way and as more thoroughly described below, the outer surface of lid 17 operates as lectern while portable sound unit 10 is in use.

One of ordinary skill in the art would know that support 24 may be likewise coupled to central body 12 or may be an entirely separate member that may be used to hold lid 17 open and at a predetermined angle relative to central body 12. In addition, two or more supports 24 may be implemented on lid 17, central body 12, or otherwise as described herein to provide additional support to hold lid 17 at a predetermined angle, which will generally be acute, as shown in FIG. 4.

Instead of support 24 holding lid 17 in an angled position, hinges 60 (FIG. 4) may be tensionally configured to support lid 17 at a predetermined angle wherein lid 17 may be used as a lectern. Thus, support 24 and hinges 60 are two of many methods, as known in the art, for enabling lid 17 to operate as a lectern.

Speakers 14 and 16 are shown in FIG. 2 as resting in a groove that secures speakers 14 and 16 in place. As shown on lid 17, groove portions 27 and 29 are configured on each lateral side of lid 17. Groove portion 27 is comprised of wall sections 31 and 33 separated by a predetermined space to therefore create groove 34. Likewise, groove portion 29 is formed by wall section 36 and 38, thereby creating groove 39. As shown in this nonlimiting example, the groove portions 27 and 29 on lid 17 are also continued on the base and sides of central body 12.

Speakers 14 and 16 each have a tongue rail 41 (on speaker 16) and 43 (on speaker 14), which comprise the male portions that fit into grooves 34 and 39. Furthermore, tongue rails 41 and 43 are shown resting in grooves 27 and 29 respectively, created on central body 12.

Figure 3:
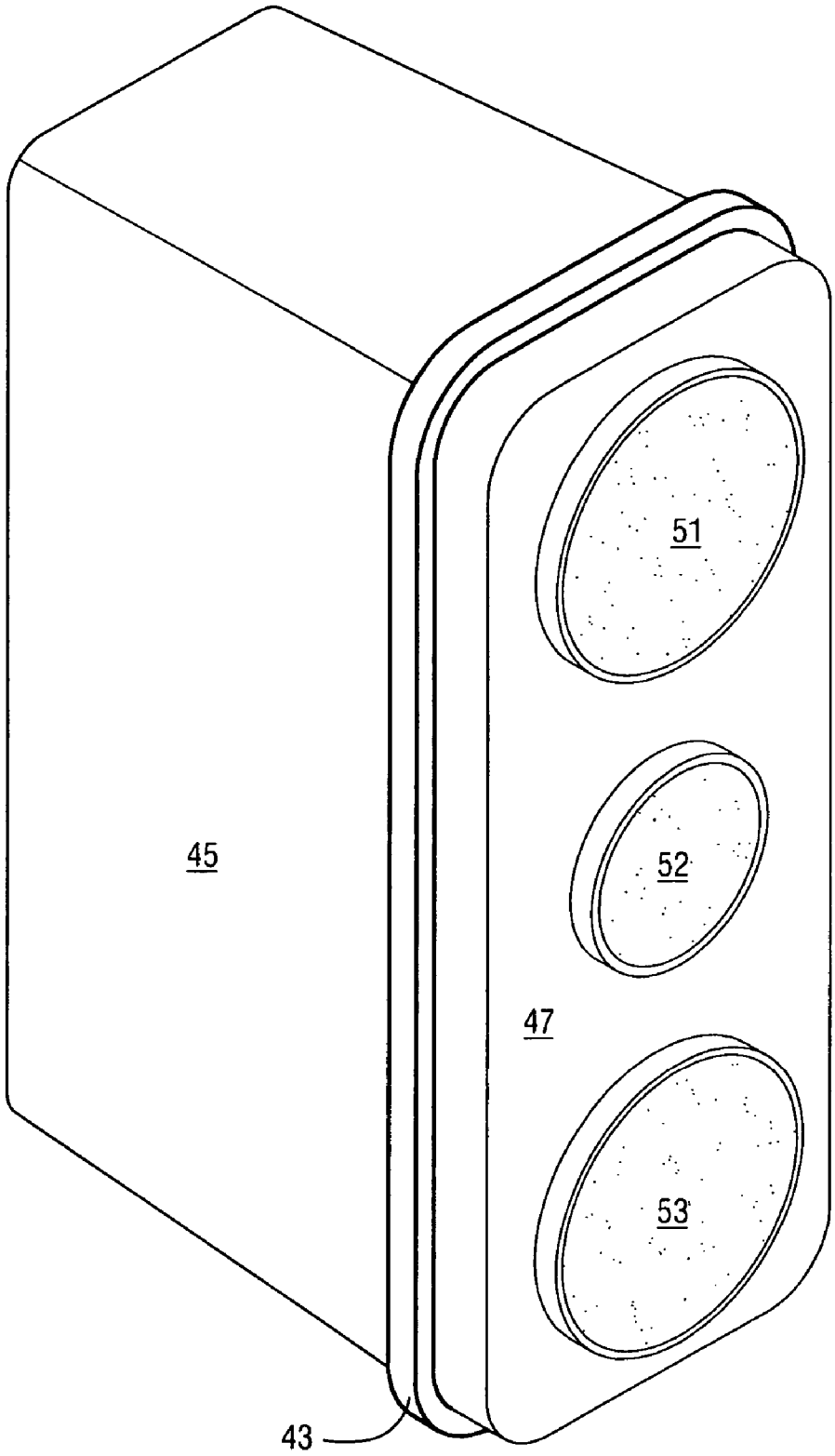
FIG. 3 is a perspective view of a speaker of the portable sound unit of FIG. 1.

FIG. 3 is a perspective view of speaker 14 of FIG. 2. In this nonlimiting example, speaker 14 is comprised of a rear section 45 that couples to a front section 47. Also shown in front section 14 is wide range driver 51, tweeter 52, and wide range driver 53. In this nonlimiting example, tongue rail 43 is shown positioned between rear section 45 and front section 47 extending completely around the outer circumference of speaker 14. Although, not separately shown is FIG. 3, speaker 16 is configured similarly to speaker 14, as shown and described herein.

Tongue rail 43 is shown rising by a predetermined amount beyond the outer surface of speaker 14 to thereby create a tongue rail, which operates as a male portion for integration with groove 39 or 34 of FIG. 2, which operates as the female portion of the "tongue-and-groove" fastening method. Upon separation from the central body 12, speaker 14 in FIG. 3 or speaker 16 in FIG. 2 may be electrically coupled to power mixer 22 of FIG. 2.

FIG. 4 is a diagram of the portable sound unit 10 shown in a separated format wherein speakers 14 and 16 are detached from central body 12. In this nonlimiting example, support 24 is shown in an extended position extending between the inside surface of lid 17 and a supporting point in central body 12.

In this nonlimiting example, lid 17 is coupled to central body 12 by hinge 60, which permits lid 17 to swing open and close. As discussed above, one of ordinary skill in the art would know that support 24 may be positioned at different points to create different angles of rise of lid 17 relative to central body 12. As a nonlimiting example, support 24 may also be positioned on ledge 55, which forms a portion of central body 12. This placement and positioning results in lid 17 being at a greater angle relative to the plane of central body 12. In the nonlimiting example wherein the surface of lid 17 is used as a lectern, the angle between lid 17 and central body 12 is acute.

Shown attached to powered mixer 22 in central body 12 are a number of input/output jacks 61. Input/output jacks 61 may comprise various inputs or outputs to mixer 22 which may be inputs from signal sources and/or outputs for signal connection to speakers 14, 16.

In this nonlimiting example, cable 58 is shown coupled between output 61 and rear input 59 of speaker 16. Likewise, cable 56 is shown coupled between a second output 61 and rear input 57 of speaker 14. One of ordinary skill in the art would know that rear speaker inputs 57, 59 may be positioned at any point on speaker 14, 16.

As speaker 16 is separated from central body 12, groove 34 of central body 12 is displayed extending around the interior surface of central body 12. One of ordinary skill would know that speakers 14, 16 may be positioned distally (wired or wirelessly) from central body 12. Indeed, if the portable sound unit 10 is used for, as a nonlimiting example, for a speech, etc., the speakers 14, 16 may be positioned in the arena, or other facility, to output the amplified voice of the speaker. Additionally, lid 17, as supported by support 24 or tensioned hinges 60, may operate as a lectern for the speaker to position items such as papers, notecards, etc., as held or stopped by edge 19.

Figure 5:
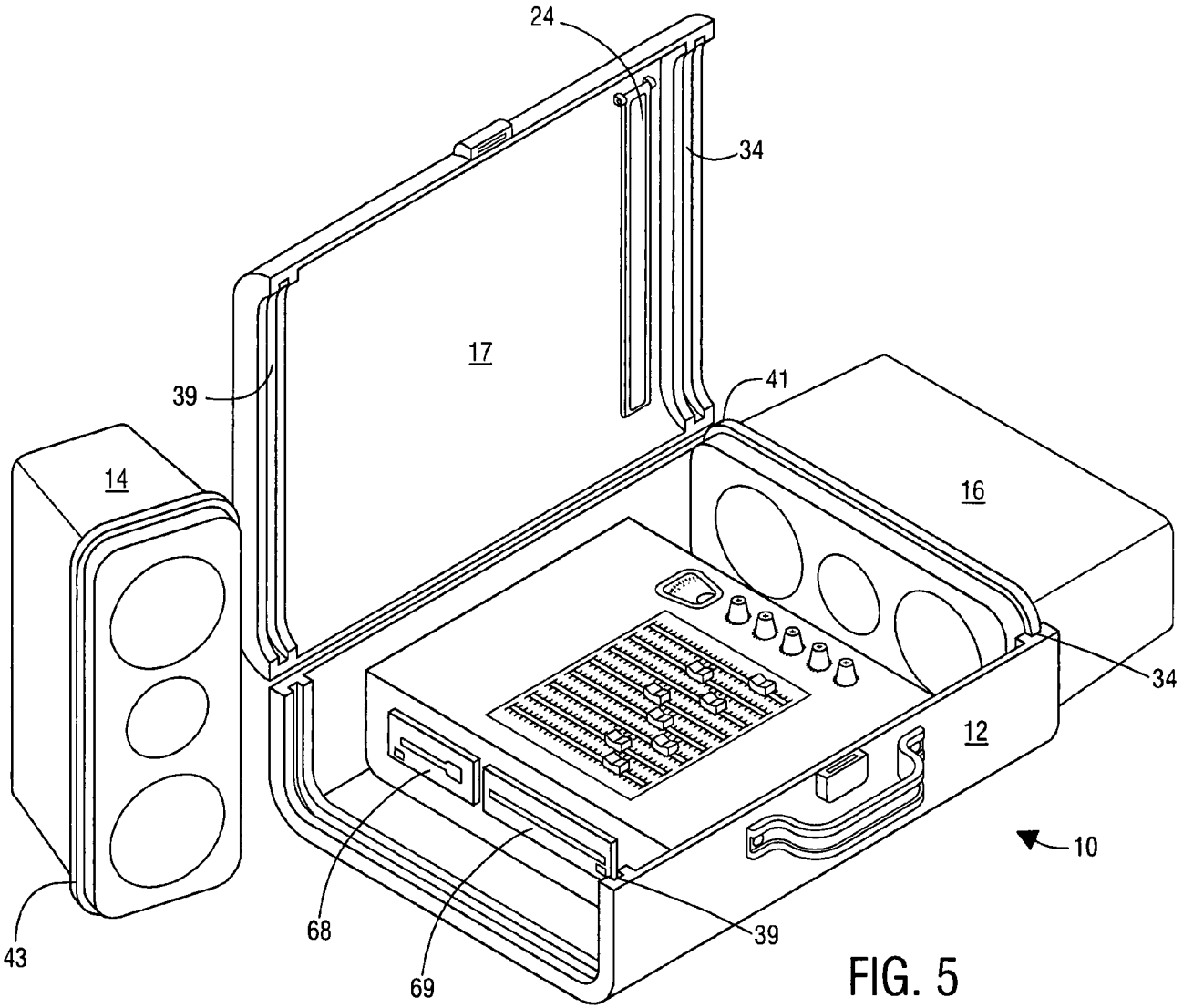
FIG. 5 is a perspective view of the portable sound unit of FIG. 1, with the lid shown in an open position and one of the speakers separated from the main unit, exposing the mixer, of FIG. 2 and exemplary signal generation devices.

FIG. 5 is another diagram of portable sound unit 10 with lid 17 shown in an open position with speaker 14 separated from central body 12 and with speaker 16 shown positioned in groove 34 of central body 12. More specifically, the tongue rail 41 of speaker 16 is shown positioned in groove 34 of central body 12. Likewise, speaker 14 is detached from central body 12 such that tongue rail 43 is separated from groove 39, which, in this nonlimiting example, extends around the interior surface of central body 12 and lid 17.

In this nonlimiting example, mixer 22 includes a cassette player 68 and a compact disc player 69 as signal generation sources for producing sound output through speakers 14 and 16. One of ordinary skill in the art would know, however, that other integral or external sound generation sources could be implemented in addition to tape cassette 68 and compact disc player 69 for producing audio output through mixer 22 and speakers 14 and 16. In addition and as nonlimiting examples, additional signal generation sources, such as an MP3 player or other computer may be electronically coupled to mixer 22 via one or more inputs 61, as shown in FIG. 4.

It should be noted that mixer 22 may be configured as any type of electronic audio manipulation equipment, as known in the art. As a nonlimiting example, mixer 22 may include an amplifier for driving speakers 14, 16.

It should be understood from FIG. 5 that when tongue rail 43 of speaker 14 and tongue rail 41 of 16 are positioned within grooves 39 or 34, respectively, and when lid 17 is in closed position on central body 12, speaker 14 and 16 are secured to central body 12. In this situation, neither speaker 14, 16 can become separated from central body 12 during transport or storage. It should be noted that speaker 14 and 16 lack any type of vibrating devices, such as latches, buckles, or other securing mechanisms to secure speaker 14 and 16 to central body 12. It is known that devices such as latches or other buckles on speakers commonly create undesired vibration noise during operation, which deteriorates overall sound quality produced by speakers 14 and 16. Thus, by the incorporation of tongue rails 41 and 43 for coupling with grooves 34 and 39, speakers 14, 16 and cannot be removed from central body 12 when lid 17 is in a closed position (FIG. 1) and do not introduce undesired sounds (rattles) during operation.

Figure 6:
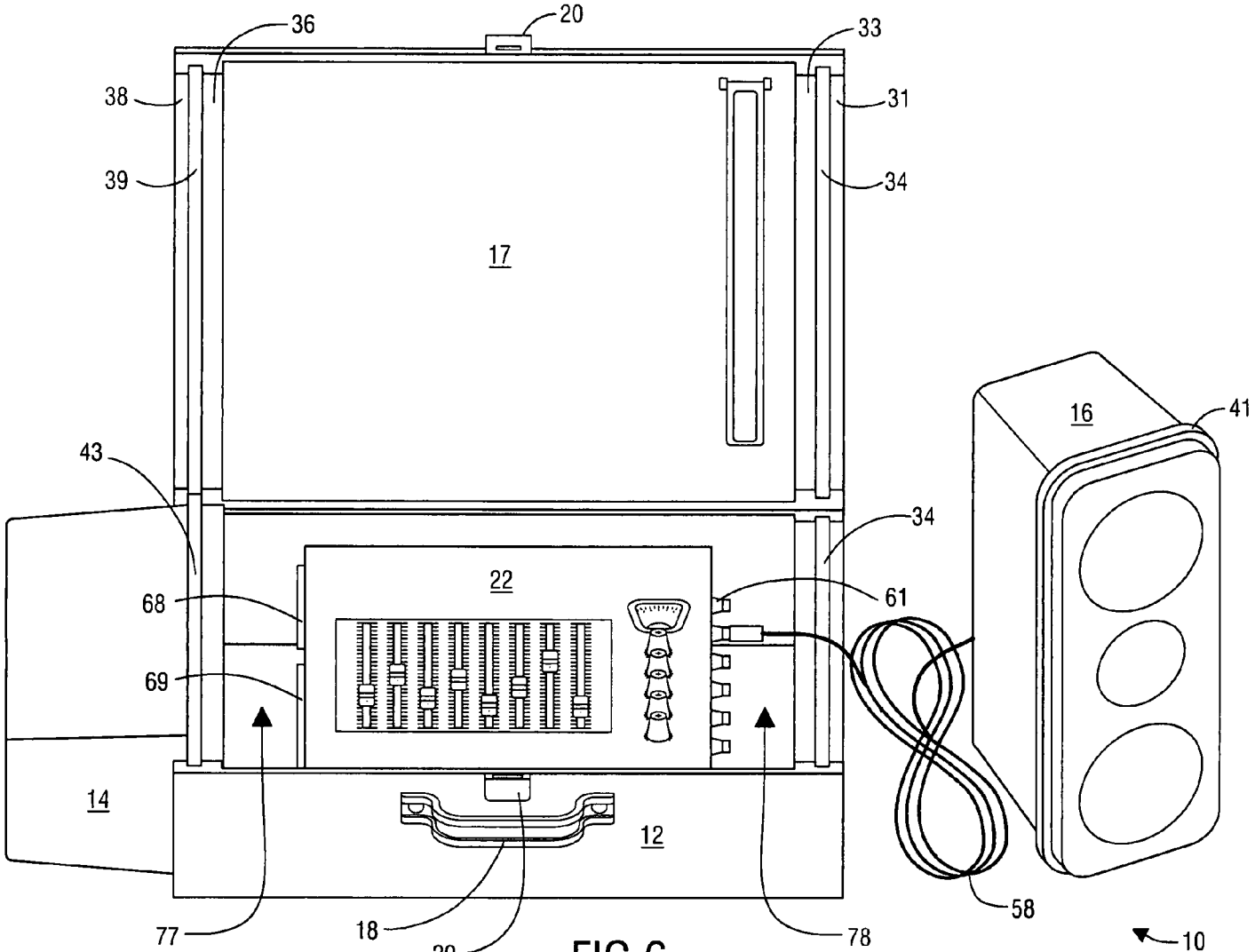
FIG. 6 is a diagram of the portable sound unit of FIG. 1 with a speaker shown detached from the main body and electrically coupled to the mixer of FIG. 2.

FIG. 6 is a diagram of the portable sound unit 10 of FIG. 1 with lid 17 shown in an open position and speaker 16 shown detached from central body 12 and electrically coupled to mixer 22. In this diagram, speaker 14 is shown with tongue rail 43 positioned in groove 39 of central body 12. Groove 39 of lid 17 is shown removed from the top portion of tongue rail 43. When speaker 14 is coupled to central body 12 via tongue rail 43 and groove 39, speaker 14 essentially becomes an integral part of central body 12. Likewise, in this nonlimiting example, speaker 16 is shown separated from central body 12 and coupled via cable 58 to output 61 of mixer 22.

Compartments 77 and 78 in central body 12 are shown as storage areas for items such as cables 58 and 56 (FIG. 4), microphones (not shown), speaker stands for placing speakers 14 and/or 16 above the ground (not shown), or any other similar item, which one of ordinary skill in the art would know may be found in and/or transported with portable sound equipment 10.

Figure 7:
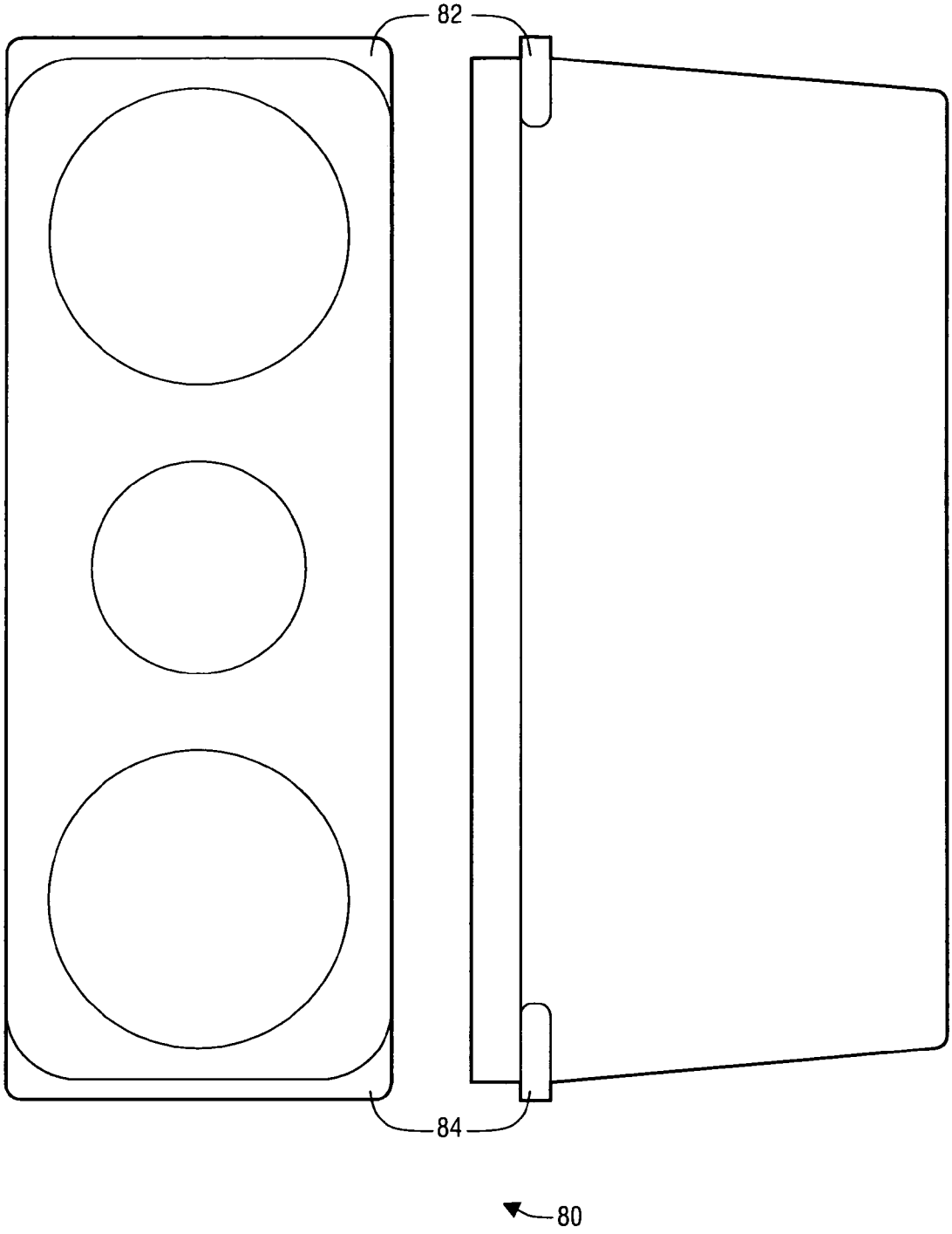
FIG. 7 is a front and side diagram of an alternative embodiment of the speaker of the portable sound unit of FIG. 1.

FIG. 7 is a diagram of speaker 80, which is an alternative embodiment of speakers 14 and 16 described above. In this alternative embodiment, speaker 80 lacks a tongue rail extending completely around the outer perimeter of the speaker 80, as described above in regard to tongue rail 43 on speaker 14 and tongue rail 41 on speaker 16. In this alternative embodiment, speaker 80 includes tongue rail 82, which, as a nonlimiting example, is placed near a top portion of speaker 80 extending along the top side of speaker 80. Likewise, speaker 80 also includes tongue rail 84 along a bottom portion of speaker 80. As shown in FIG. 7, neither tongue rail 82 nor tongue rail 84 substantially extend along the vertical sides of speaker 8. Instead, tongue rails 82 and 84 are positioned on the top and bottom portions in this nonlimiting example.

Figure 8:
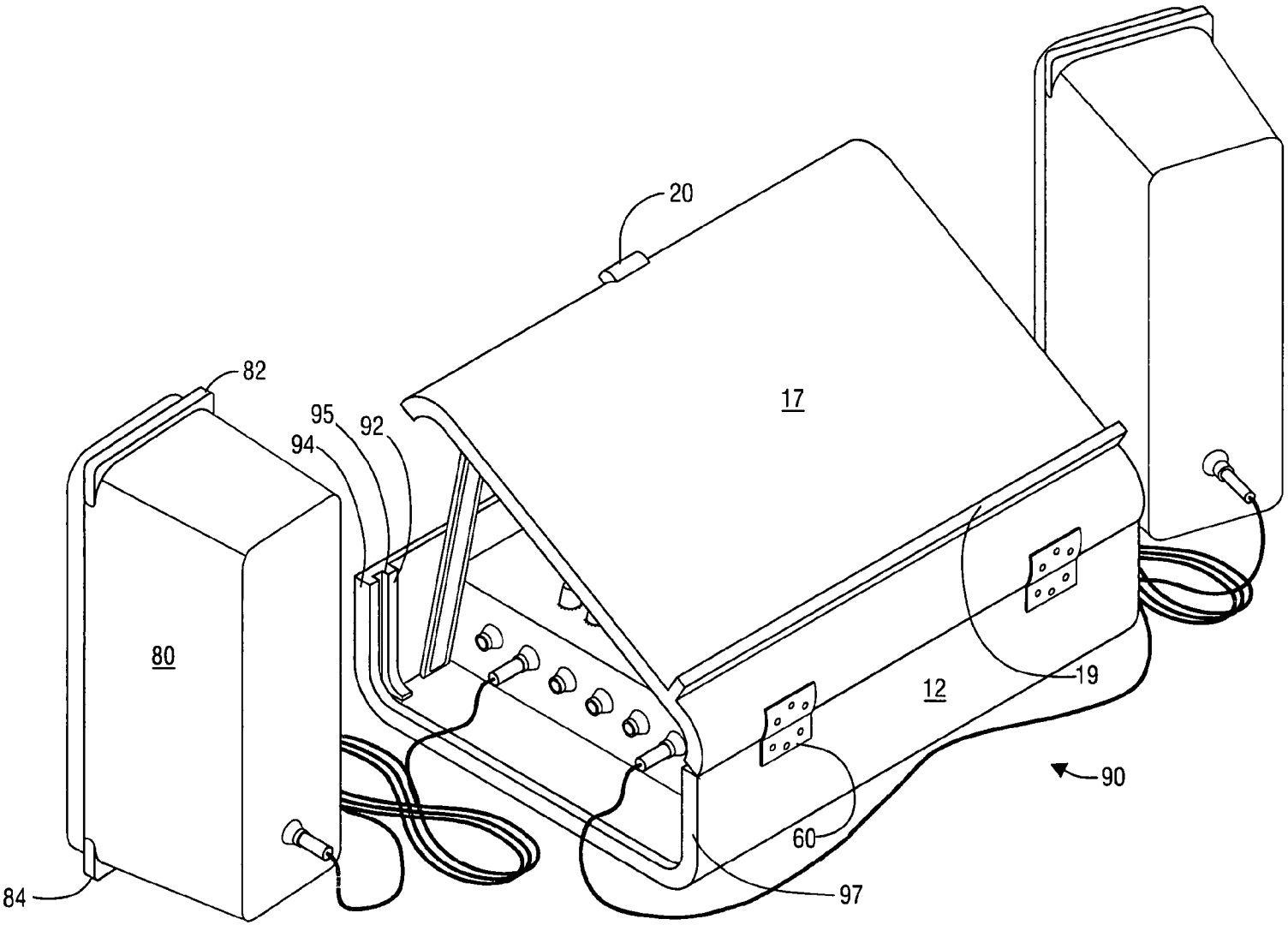
FIG. 8 is a diagram of an alternative embodiment of the portable sound unit of FIG. 1, which also depicts the lid as a lectern.

FIG. 8 displays portable sound unit 90 with the speaker 80 of FIG. 7. Central body 12 is configured with groove rails appropriately positioned for securing speaker 80 to central body 12.

As stated above, speaker 80 includes tongue rails 82 and 84 at the top and bottom sections of speaker 80. Likewise, central body 12 is configured with groove 95 along with the vertical walls of central body 12. More specifically, groove 95 is surrounded by wall sections 92 and 94 to create groove 95. Likewise, wall section 97 is also placed near an additional inner wall section (not shown), but similar to wall section 92. In this fashion, speaker 80 may be positioned within groove 95 and the corresponding groove proximate to wall 97 for securing speaker 80 to central body 12. It should be noted that similar wall sections and grooves are located at the other opening in central body 12.

One of ordinary skill in the art would also know that the tongue rail and groove system as described in this alternative embodiment may be configured in a multitude of fashions such that the tongue rails 82 and 84 are placed on different portions of speaker 80, such as in one nonlimiting example on the vertical side portions of speaker 80 for mating with central body 12.

Figure 9:
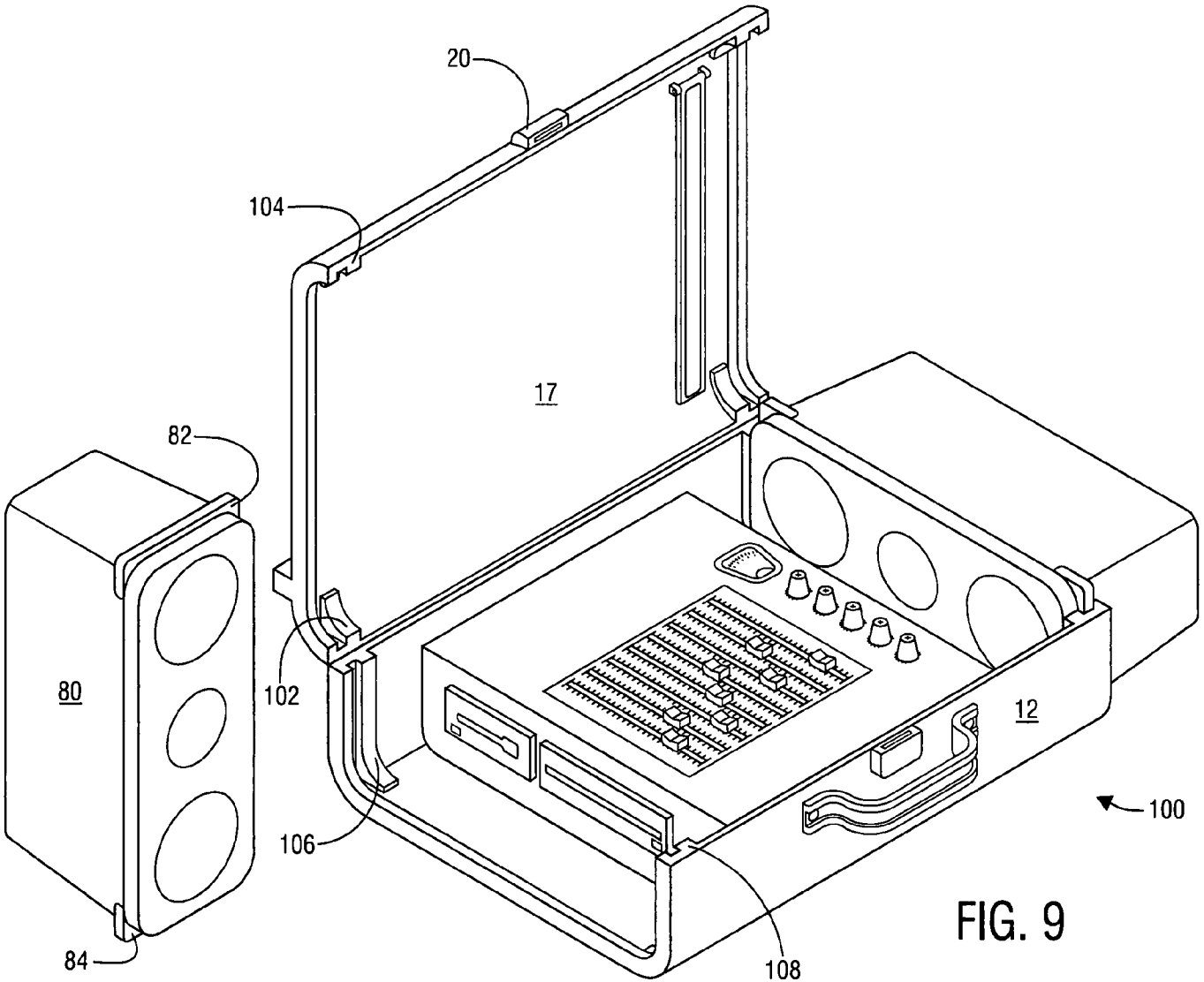
FIG. 9 is a diagram of yet another alternate embodiment of the portable sound unit of FIGS. 1 and 2.

Another such alternative embodiment is shown in FIG. 9. Here, inside wall sections 102, 104 on lid 17 couple to inside wall sections 106, 108 on central body 12 to secure tongue rails 82 and 84 to central body 12. In this nonlimiting example, tongue rails 82, 84 do not extend completely around speaker 80, and grooves 102, 104, 106, 108 do not extend completely around the interior of central body 12. Yet, when lid 17 is in a closed position and latch 20 is locked, speaker 80 is secured to central body 12 and cannot become unattached.

In yet another embodiment, the tongue rails and the corresponding grooves may be configured in reverse fashion as described above. More specifically, the grooves of the previously described tongue-and-groove configuration may also be configured on the speakers 14, 16. Likewise, the tongue rails may also be configured on central body 12 (in the position of the grooves in, for example, FIG. 6). This alternative embodiment shows that the male and female portions of the tongue and groove assembly may be on either the central body or the speakers, respectively, to the extent that the speakers 14, 16 may slidably couple to the central body by the tongue-and-groove assembly.

It should be emphasized that the above-described embodiments, particularly, any "preferred" embodiments, are merely possible examples of implementations, merely set forth for a clear understanding of the principles of this disclosure. Many variations and modifications may be made to the above-described embodiments without departing substantially from the spirit and principles this disclosure. All such modifications and variations are intended to be included herein within the scope of this disclosure and protected by the following claims.

I claim:

1. A portable sound unit, comprising:

one or more speakers, each having tongue rails around a portion of the circumference of the speaker;

a central case with a openable lid, the central case having openings at either end when the lid is in a closed position and the lid configured to maintain the acute angle when in an open position;

electronic audio manipulation equipment contained in the central case having one or more inputs and outputs;

one or more grooves inside a portion of the central case near each of the openings or receipt of the tongue rails of the one or more speakers when the lid is in an open position such that the one or more speakers may be secured to the central case when the lid is closed; and an edge fashioned along at least a portion of the width of the outer surface of the lid, the edge configured to hold items against the outer surface of the lid hen the lid maintains an open position.

2. The portable sound unit of claim 1, wherein tongue rails of the one or more speakers are configured completely around the outer circumference of the one or more speakers, and wherein the grooves near each of the openings extend completely around the interior of the case so that the tongue rails on each side of the outer circumference of the one or more speakers is positioned in a groove when the lid is in a closed position thereby preventing each of the one or more speakers from separating from the central case when the lid is in the closed position.

3. The portable sound unit of claim 1, further comprising:

means for connecting electronic signals between the electronic audio manipulation equipment and each speaker when the speaker is distally positioned from the central case.

4. The portable sound unit of claim 1, further comprising:

a lip configured on the outer portion of the central case at each of the openings to prevent the one or more speakers from separating from the central case when the lid is in a closed position and the tongue rails of the one or more speakers are positioned in the grooves at one of the openings, wherein the grooves inside the central case near each of the openings do not extend completely around each of the openings.

5. The portable sound unit of claim 1, wherein the one or more speakers lack securing agents that vibrate when the one or more speakers produce sound.

6. The portable sound unit of claim 1, further comprising:

a supporting member coupled to the inner surface of the lid to hold the lid at an acute angle relative to the central case.

7. The portable sound unit of claim 1,further comprising:

a supporting member coupled to an interior portion of the central case and adjustable to support the lid at an acute angle relative to the central case.

8. The portable sound unit of claim 1, further comprising:

one or more hinges coupled to the central case and the lid, the hinges configured to hold the lid at an acute angle relative to the central case when the lid is in an open position.

9. portable sound unit of claim 1, wherein the outer surface of the lid comprises a lectern when in the open position.

10. The portable sound unit of claim 1, further comprising:

a handle coupled to the central case.

11. The portable sound unit of claim 1, further comprising:

one or more storage compartments within the central case.

12. The portable sound unit of claim 1, wherein the electronic audio manipulation equipment is coupled to one or more signal input devices.

13. The portable sound unit of claim 12, wherein the signal generating device is a compact disc player.

14. A portable sound unit, comprising:

one or more speakers, each having grooves around a portion of the circumference of the speaker;

a central case with an openable lid permitting access to sound manipulation equipment contained within the central case, the central case having openings at either end when the lid is in a closed position and tongue rails inside a portion of the central case near each of the openings for receipt of the grooves of the one or more speakers when the lid is in an open opposition such that the one or more speakers may be secured to the central case when the lid is closed;

the lid having a stop for holding items against the lid when the lid is opened forming a lectern.

15. The portable sound unit of claim 14, wherein the outer surface of the lid operates a lectern when the lid is positioned in the open position.

* * * * *

US007469052C1

(12) EX PARTE REEXAMINATION CERTIFICATE (10787th)

United States Patent

Peavey

(10) Number: US 7,469,052 C1

(45) Certificate Issued: Jan. 7, 2016

(54) PORTABLE SOUND SYSTEM, APPARATUS, AND METHOD

(75) Inventor: Hartley D. Peavey, Meridian, MS (US)

(73) Assignee: PEAVEY ELECTRONICS CORPORATION, Meridian, MS (US)

Reexamination Request:
No. 90/012,922, Jul. 18, 2013

Reexamination Certificate for:

| | |
|---|---|
| Patent No.: | **7,469,052** |
| Issued: | **Dec. 23, 2008** |
| Appl. No.: | **10/872,260** |
| Filed: | **Jun. 18, 2004** |

(51) Int. Cl.

| | |
|---|---|
| ***H04R 9/06*** | (2006.01) |
| ***H04R 1/02*** | (2006.01) |
| ***H04R 27/00*** | (2006.01) |

(52) U.S. Cl.
CPC ..... *H04R 1/02* (2013.01); *H04R 2420/07* (2013.01); *H04R 2499/11* (2013.01)

(58) Field of Classification Search
None
See application file for complete search history.

(56) References Cited

To view the complete listing of prior art documents cited during the proceeding for Reexamination Control Number 90/012,922, please refer to the USPTO's public Patent Application Information Retrieval (PAIR) system under the Display References tab.

*Primary Examiner* — John M Hotaling

(57) ABSTRACT

A portable sound unit is shown having a central case and one or more speakers. Each speaker has tongue rails around a portion of its circumference. The central case includes an openable lid permitting access to sound equipment contained within the central case. The central case has openings at either end when the lid is closed and grooves inside a portion of the central case near each opening. The grooves receive the tongue rails on the speaker when the lid is open. Upon positioning a speaker in the grooves in the central body, the lid may be closed, thereby securing the speakers to the central case. When the speakers are separated from the central case and electronically coupled to the sound equipment, the opened lid may serve as a lectern.

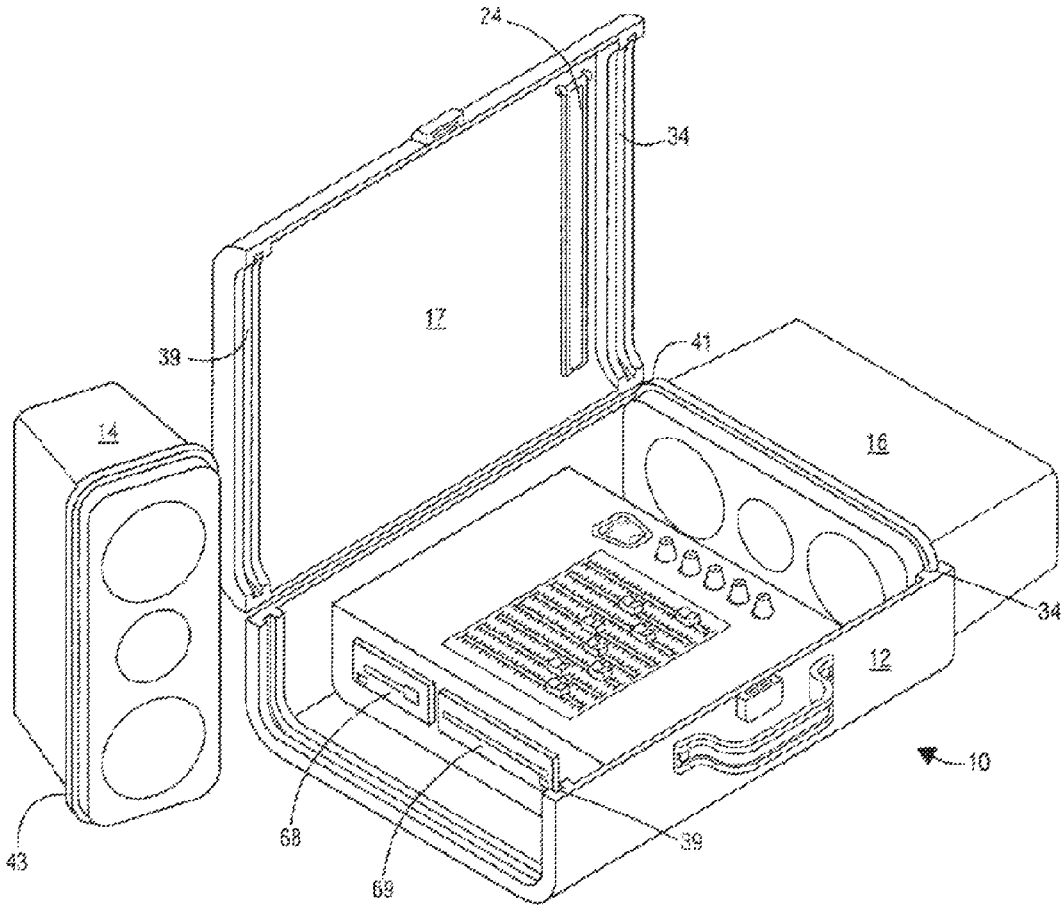

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

The patentability of claim 2 is confirmed.

Claims 1 and 3-15 are cancelled.

* * * * *